US010961783B2

(12) United States Patent
Chichester-Constable

(10) Patent No.: US 10,961,783 B2
(45) Date of Patent: Mar. 30, 2021

(54) HOLE BORING DEVICE

(71) Applicant: Kevin Chichester-Constable, Spring City, PA (US)

(72) Inventor: Kevin Chichester-Constable, Spring City, PA (US)

( * ) Notice: Subject to any disclaimer, the term of this patent is extended or adjusted under 35 U.S.C. 154(b) by 91 days.

(21) Appl. No.: 15/865,873

(22) Filed: Jan. 9, 2018

(65) Prior Publication Data

US 2019/0024458 A1 Jan. 24, 2019

Related U.S. Application Data

(60) Provisional application No. 62/536,017, filed on Jul. 24, 2017.

(51) Int. Cl.

| | |
|---|---|
| ***E21B 7/18*** | (2006.01) |
| ***E21B 11/00*** | (2006.01) |
| ***E21B 7/02*** | (2006.01) |

(52) U.S. Cl.

CPC ..... *E21B 7/18* (2013.01); *E21B 7/028* (2013.01); *E21B 11/005* (2013.01)

(58) Field of Classification Search

CPC ..... E21B 7/18; E21B 11/005

See application file for complete search history.

(56) References Cited

U.S. PATENT DOCUMENTS

| | | | | |
|---|---|---|---|---|
| 629,539 | A * | 7/1899 | Bertram | E21B 7/008 175/18 |
| 3,053,331 | A * | 9/1962 | Corley | E21B 7/28 175/202 |
| 3,123,163 | A * | 3/1964 | Overby | E21B 11/005 175/404 |
| 3,273,930 | A * | 9/1966 | Gottfried | A01G 20/30 111/101 |
| 3,638,741 | A | 2/1972 | Zizak | |
| 4,787,465 | A * | 11/1988 | Dickinson, III | E21B 7/065 175/393 |
| 4,986,373 | A | 1/1991 | Charland et al. | |
| 6,196,337 | B1 | 3/2001 | Sikes | |
| 6,470,605 | B1 * | 10/2002 | Gilman | E02F 3/8816 37/323 |
| 6,564,880 | B2 | 5/2003 | Williams et al. | |
| 8,500,095 | B1 | 8/2013 | Salcedo | |
| 8,944,187 | B1 | 2/2015 | Cordova et al. | |

(Continued)

*Primary Examiner* — Blake E Michener

(74) *Attorney, Agent, or Firm* — Boudwin Intellectual Property; Daniel Boudwin

(57) ABSTRACT

A hole boring device includes a housing including a proximal end, an open distal end, and a bore extending longitudinally from the distal end to the proximal end. An inlet connectable to a pressurized water source is disposed on the proximal end of the housing. A spraying device in fluid communication with the inlet is disposed in the bore and is oriented towards the open distal end of the housing. The spraying device is configured discharge a stream of water passing therethrough so as to form a boring stream configured to bore a hole in a ground surface. In some embodiments, the spraying device is configured to rotatably discharge the pressurized stream of water. A depth collar disposed annularly about the housing defines the depth of the bored hole. A slot disposed along the housing allows debris from the boring process to exit the housing, leaving an empty bored hole.

8 Claims, 9 Drawing Sheets

(56) References Cited

U.S. PATENT DOCUMENTS

| | | | | |
|---|---|---|---|---|
| 10,385,537 | B1 * | 8/2019 | Nelson | E02F 3/8891 |
| 2008/0110629 | A1 * | 5/2008 | Belew | E21B 7/046<br>166/298 |
| 2010/0060022 | A1 | 3/2010 | Alcov | |
| 2014/0054092 | A1 * | 2/2014 | Buckman, Sr. | E21B 7/18<br>175/107 |
| 2016/0145944 | A1 | 5/2016 | Reed et al. | |

* cited by examiner

HOLE BORING DEVICE

CROSS REFERENCE TO RELATED APPLICATIONS

This application claims the benefit of U.S. Provisional Application No. 62/536,017 filed on Jul. 24, 2017. The above identified patent application is herein incorporated by reference in its entirety to provide continuity of disclosure.

BACKGROUND OF THE INVENTION

The present invention relates to devices for boring holes into the earth. More specifically, the present invention relates to a hole boring device including a spraying device configured to connect to a pressurized water source, and further including a nozzle configured to rotatably discharge a stream of high pressure water for boring a hole in a ground surface.

There are a variety of situations which require making elongated and relatively deep holes into the ground. These include digging generally cylindrically-shaped holes for planting bulbs, receiving fence posts, sign posts and the like. Digging relatively deep, elongated holes such as bulb holes in the ground tends to be a tedious, slow, and labor intensive task when employing conventional manually operated or manually powered digging implements. One way to create such a hole is to utilize a manually powered clamshell-type hole digger, which includes a pair of shovels having generally semi-circularly curved blades. The shovel blades are fixed to the lower ends of upwardly protruding handles which are pivotably mounted to one another at a location between the shovel blades and the upper ends of the handles. The shovel blades are arranged so that the concave surfaces of the shovel blades face one another to define a generally cylindrically-shaped space corresponding to the shape a hole to be dug. While this device is widely used, using a clamshell-type digger is a labor-intensive process requiring manual operation of the handles and downward force exerted onto the earth in order to penetrate, loosen, and remove the earth with the shovel blades. Much repetition is required to complete a project in which numerous holes are required and in which a larger depth needs to be bored, which can be tiresome.

Another method of forming holes in the earth is to employ a large diameter auger that is rotated by an electric, hydraulic, or air-driven motor. Boring holes with a powered auger of this type is much quicker and easier than using a clamshell-type digger tool. However, these auger devices are overly bulky and difficult to handle by untrained individuals. Further, the auger devices are prohibitively expensive because they include electric or hydraulic parts, which limits the extent to which the auger can be used.

While the above devices fulfill their respective, particular objectives, and requirements, the devices in the known art are lacking, and further fail to provide a hole boring device adapted for household and simplified commercial use for the purpose of digging holes, such as bulb holes, fence or post holes, and removing the soil and debris therefrom. In light of the devices disclosed in the known art, it is submitted that the present invention substantially diverges in design elements from the known art and consequently it is clear that there is a need in the art for an improvement to hole boring devices. In this regard the present invention substantially fulfills these needs.

SUMMARY OF THE INVENTION

In view of the foregoing disadvantages inherent in the known types of hole boring devices now present in the prior art, the present invention provides a hole boring device wherein the same can be utilized for providing convenience for the user when boring holes into the earth.

In one example embodiment of the present invention, the hole boring device includes a housing including a proximal end, an open distal end, and a bore extending longitudinally from the distal end to the proximal end, an inlet disposed on the proximal end, the inlet configured to receive a connection to a pressurized water source, and a spraying device disposed in the bore and oriented towards the open distal end, the spraying device in fluid communication with the inlet, wherein the spraying device is configured discharge a stream of water passing therethrough so as to form a boring stream configured to bore a hole in a surface.

In one example embodiment of the present invention, the hole boring device further includes a cover disposed within the bore at the proximal end of the housing, wherein the inlet extends through a central opening of the cover, the cover configured to seal the bore at the proximal end of the housing.

In one example embodiment of the present invention, the hole boring device further includes a collar disposed annularly about the housing, wherein the collar is slidable along a longitudinal length of the housing, and a plurality of collar apertures disposed on an outer side of the collar, each of the plurality of collar apertures configured to receive a collar set screw, wherein each collar set screw is configured to secure the collar in a desired position along the housing.

In one example embodiment of the present invention, the hole boring device further includes a slot extending along the longitudinal length of the housing and disposed between the proximal end and the open distal end, the slot in communication with the longitudinal bore such that debris entering the longitudinal bore during the hole boring process translates from the longitudinal bore through the slot and out of the housing.

In one example embodiment of the present invention, the hole boring device further includes a spraying device that includes a rotatable nozzle configured to rotate when water flows therethrough in order to rotatably discharge a stream of water through the open distal end of the housing.

In one example embodiment of the present invention, the hole boring device includes a housing including a proximal end, an open distal end, and a bore extending longitudinally from the distal end to the proximal end, a motor including a motor housing having a central opening and a shaft extending downward therefrom, an inlet extending through the central opening of the motor housing, the inlet configured to receive a connection to a pressurized water source, a cover insertable into the proximal end of the housing, the cover including a central aperture through which the motor shaft extends and a plurality of water apertures disposed annularly about the central aperture, the plurality of water apertures in fluid communication with the inlet, and a rotary spray ball in fluid communication with the plurality of water apertures of the cover, the rotary spray ball including a plurality of outlets, the rotary spray ball operably connected to the shaft of the motor, wherein the motor is configured to rotate the rotary spray ball in order to rotatably discharge a stream of water therefrom.

An object of the present invention is to provide a hole boring device adapted for household and simplified commercial use for the purpose of digging holes, such as holes for planting flowers, trees, shrubs, and the like, and removing the soil and debris therefrom.

Another object of the present invention is to provide a hole boring device that provides initial watering of the plant or bulb, thereby simultaneously completing the two tasks of hole drilling and initial watering.

A further object of the present invention is to provide a hole boring device that allows liquid fertilizer to be mixed into the pressurized water stream that bores the hole, so that an individual can bore a hole, provide initial watering for the plant or bulb, and fertilize the plant or bulb with a single device.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
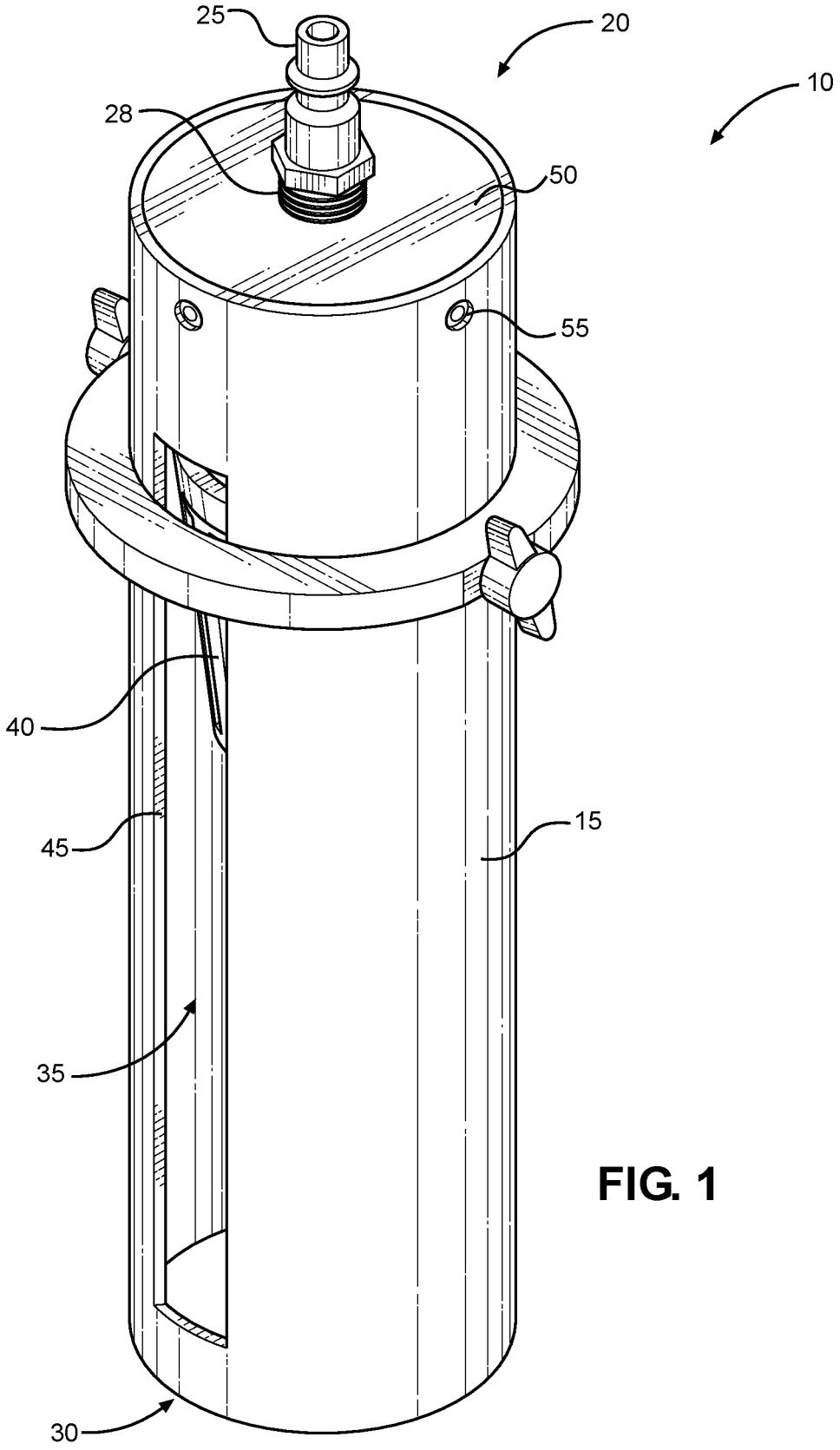
FIG. 1 shows a perspective view of one embodiment of the hole boring device.

Reference is made herein to the attached drawings. Like reference numerals are used throughout the drawings to depict like or similar elements of the hole boring device. The figures are intended for representative purposes only and should not be considered to be limiting in any respect.

Figure 2:
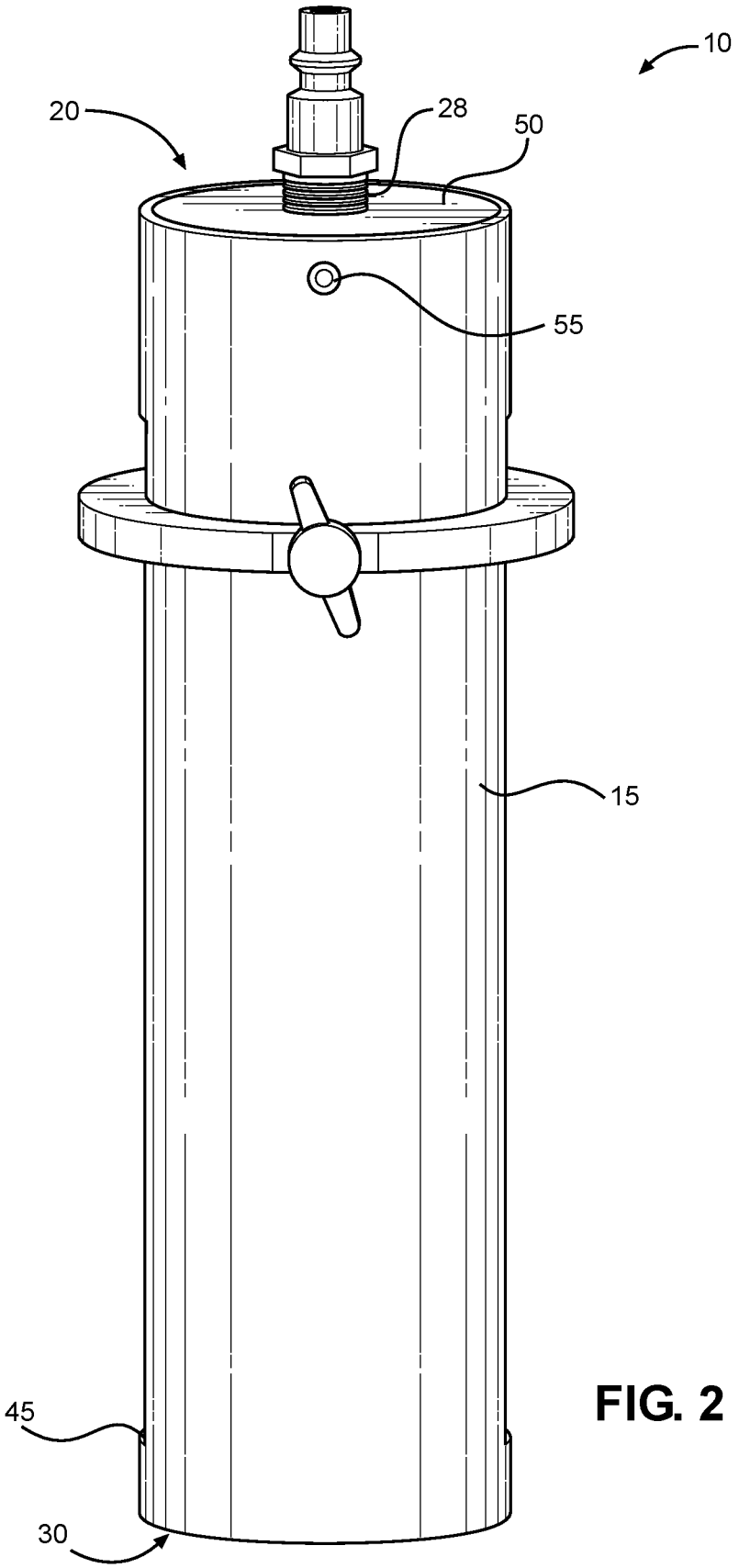
FIG. 2 shows a side perspective view of one embodiment of the hole boring device.

Referring now to FIGS. 1 and 2, there is shown a perspective view of one embodiment of the hole boring device and a side perspective view of one embodiment of the hole boring device, respectively. The present invention provides a hole boring device 10 configured to bore holes into the earth using pressurized water. The hole boring device 10 comprises an elongated cylindrical housing 15 including a proximal end 20 having an inlet 25, an open distal end 30, a bore 35 extending through a longitudinal length of the housing 15 from the proximal end 20 to the open distal end 30, and a spraying device 40 disposed within the bore 35. The diameter of the housing 15 can vary depending on the purpose for which the hole is being bored. For example, the housing 15 may have a diameter within a range of one to two inches for boring holes for small flower bulbs, a diameter within a range of two to four inches for planting larger flower bulbs or small plants, or a diameter within a range of four to ten inches for planting larger plants and small trees.

In the shown embodiment, the hole boring device 10 includes a slot 45 in communication with the bore 35 that extends along the longitudinal length of the housing 15. The slot 45 is configured to provide egress for mud and debris that accumulates in the bore 35 while utilizing the hole boring device 10 to bore holes in the ground. The slot 45 allows debris entering the bore 35 during the hole boring process to translate from the bore 35 through the slot 45 and out of the housing 15. In one embodiment, the slot 45 includes a longitudinal length less than the longitudinal length of the housing 15 and is disposed between the proximal end 20 and open distal end 30 such that the slot 45 is coterminous with neither the proximal end 20 nor the open distal end 30.

Figure 3:
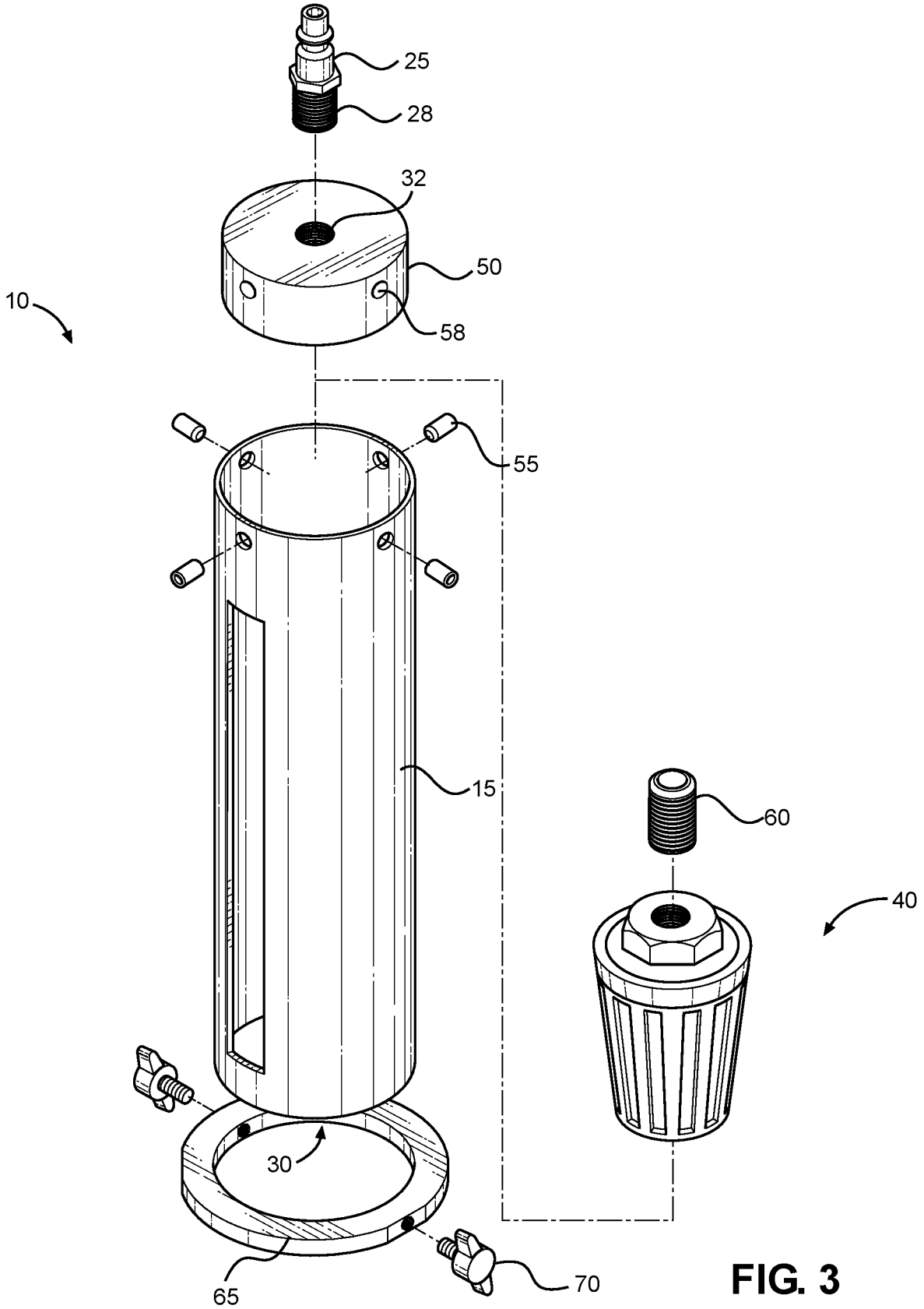
FIG. 3 shows a cross-sectional view of one embodiment of the hole boring device.

A cover 50 is fastened to the proximal end 20 of the housing 15. The cover 50 includes a central aperture 32 through which the inlet 25 extends, as shown in FIG. 3. The inlet 25 is configured to receive a connection from a pressurized water source, such as a power washer or pressurized washer. The cover 50 seals the bore 35 at the proximal end 20 such that no fluid or debris can exit through the proximal end 20 during the hole boring process.

In the depicted embodiment, the cover 50 includes a diameter less than a diameter of the bore 35, such that the cover 50 is configured to be inserted into the bore 35 at the proximal end 20 in order to block or seal the proximal end 20 of the housing 15. The cover can be secured within the bore 35 via a threaded connection therewith. In the shown embodiment, an upper surface of the cover 50 is flush with an upper edge of the proximal end 20 of the housing 15. However, in alternate embodiments, the cover 50 can be recessed into the proximal end 20 of the housing 15 or extend upwardly therefrom. In one embodiment, the cover 50 includes one or more fasteners 55 configured to removably secure to one or more apertures 58 disposed annularly around the cover 50 so as to removably secure the cover 50 within the proximal end 20 of the housing 15, as shown in FIG. 3.

In the depicted embodiment, the inlet 25 comprises a male quick disconnect inlet 28 threadably coupled the central cover aperture 32, which includes a female threaded bore configured for removably attaching and interchanging the inlet 25 in order to facilitate compatibility with a variety of pressurized washers, as shown in FIG. 3. In some embodiments, the male quick disconnect inlet 28 is integral to the cover 50 and may be molded or machined from a single piece of material. In another embodiment, the inlet 25 is integral to the cover aperture 38 so as to be permanently affixed to within the cover 50. In yet another embodiment, the inlet 25 can include a female quick disconnect inlet.

Figure 4:
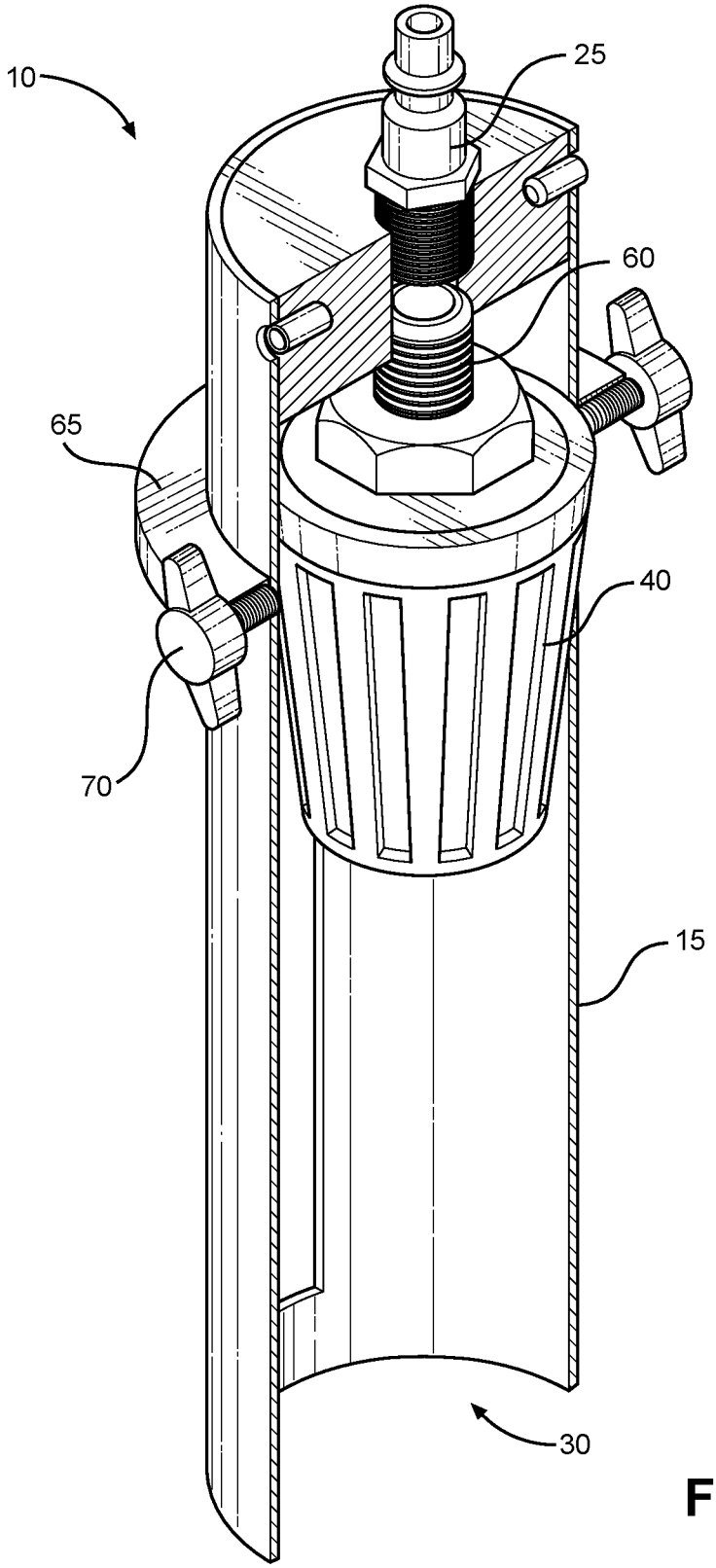
FIG. 4 shows an exploded view of one embodiment of the hole boring device.

Referring now to FIGS. 3 and 4, there is shown an exploded view of one embodiment of the hole boring device and a cross-sectional view of one embodiment of the hole boring device, respectively. The spraying device 40 is secured within the interior of the bore 35. In the depicted embodiment, the spraying device 40 is secured to an interior surface 52 of the cover 50. The spraying device 40 includes a nipple 60 in fluid communication with the inlet 25, such that the nipple 60 can receive water therein when the inlet 25 is coupled to a pressurized water source. In the depicted embodiment, the nipple 60 is threadably coupled to a lower end of the central cover opening 32.

The spraying device 40 is orientated vertically downwardly towards the open distal end 30 of the housing 15, such that the spraying device 40 sprays a stream of water downwardly out through the open distal end 30 when a pressurized water source is connected to the inlet 25. In the shown embodiment, the spraying device 40 includes internal components that rotate to create a revolving fluid stream, such that the stream is rotatably discharged from the spraying device. In operation, the revolving fluid stream punctures a ground surface and bores a hole therein. The revolving fluid stream covers a larger or wider area than a linear stream of water, thereby optimizing boring. The housing 15 restricts the lateral reach of the revolving fluid stream of the spraying device 40, such that the diameter of the bore 35 defines the area in which the spraying device 40 ejects water. In other words, the size of a hole bored by the hole boring device 10 is dependent upon the size of the diameter of the bore 35. For instance, the hole boring device 10 can include larger housings including bores of larger diameters, which allows the hole boring device 10 to bore wider holes.

In the depicted embodiment, the spraying device 40 includes a rotary nozzle with internal components that are configured to rotate to create a revolving fluid stream. However, alternate embodiments of the invention may include different types of spraying devices 40. For example, in another embodiment, the present invention utilizes multiple spraying devices 40 such that there are a plurality of nozzles each configured to rotatably discharge a stream of water passing therethrough. In yet another embodiment, the spraying device 40 includes a rotating spray ball apparatus including a shaft having a ball rotatably coupled to an end thereof. In some embodiments, the spraying device 40 can also be coupled to a motor configured to rotate the spraying device 40 in order to form the revolving boring stream.

An adjustable depth collar 65 is disposed annularly around the housing 15 and is slidable along the longitudinal length thereof, such that a user may adjust the position of the depth collar 65. The position of the depth collar 65 defines the depth to which the hole boring device 10 may bore, because the lower end of the depth collar 65 contacts the ground and prevents further insertion of the housing 15 into the ground. In the shown embodiment, the depth collar 65 includes a circular outer perimeter. However, as long as the inner perimeter of the depth collar 65 is circular such that it can receive the housing 15, the shape of the outer perimeter of the depth collar 65 can vary.

The depth collar 65 includes a plurality of collar apertures disposed on an outer side of the collar 65, and each collar aperture is configured to receive a set screw 70. The set screws 70 secure the collar in a desired position along the housing 15. In alternate embodiments, the housing 15 or the depth collar 65 may include markings, grooves, or detents that allow the depth collar 65 to be positioned precisely about the housing 15, such that the depth collar 65 is unable to rotate about the housing 15.

Figure 5:
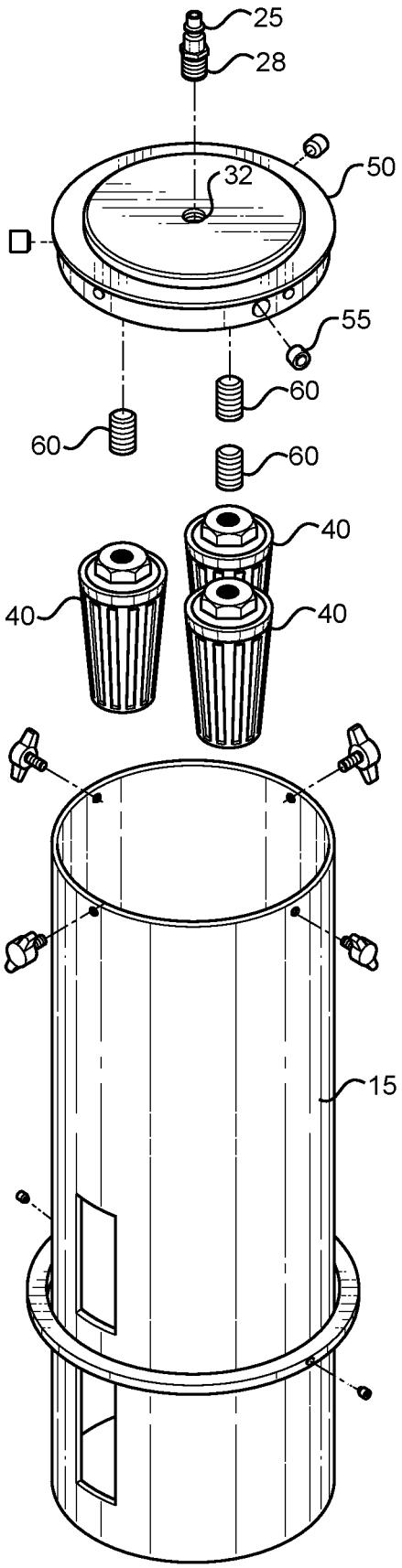
FIG. 5 shows an exploded view of a first alternate embodiment of the hole boring device.
Figure 6:
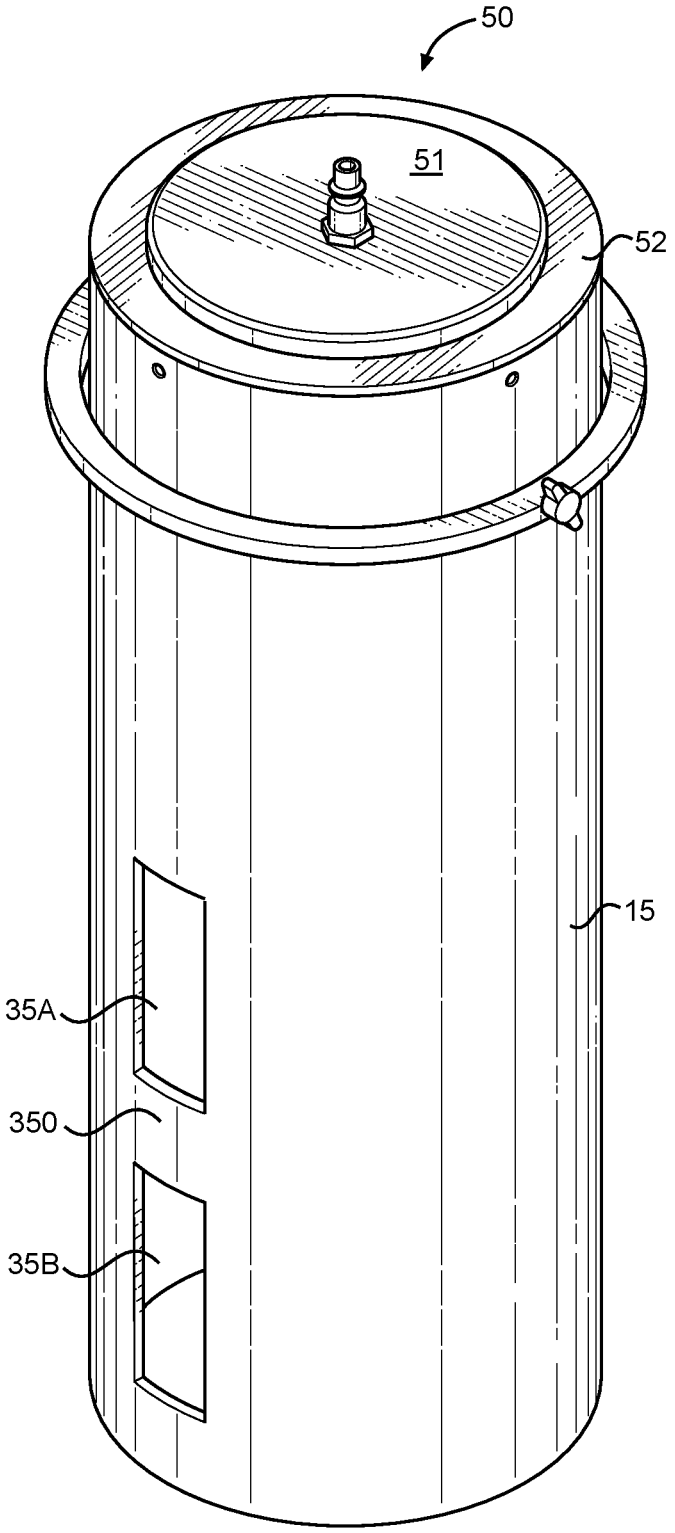
FIG. 6 shows a perspective view of a first alternate embodiment of the hole boring device.

Referring now to FIGS. 5 and 6, there is shown an exploded view of a first alternate embodiment of the hole boring device and a perspective view of a first alternate embodiment of the hole boring device, respectively. In the shown embodiment, the hole boring device utilizes multiple spraying devices 40. The spraying devices 40 are orientated vertically downwardly towards the open distal end 30 of the housing 15, such that the spraying devices 40 simultaneously discharge a stream of water downwardly out through the open distal end 30 when a pressurized water source is connected to the inlet 25. The spraying devices 40 can be configured to rotate or spin as the stream of water passes therethrough, such that multiple streams are rotatably discharged from the spraying device. Additionally, the cover 50 in the shown embodiment includes a planar perimeter portion 52 disposed annularly about a central face 51 that is offset from the perimeter portion 52.

The spraying devices 40 each include a nipple 60 in fluid communication with the inlet 25, such that the nipples 60 can receive water when the inlet 25 is coupled to a pressurized water source. For example, the nipples 60 can each be connected to a manifold that distributes water equally from the inlet 25 to the nipples 60. The shown embodiment further includes a variation on the slot that allows debris to exit the housing 15. As shown, the slot includes an upper slot 35A and a lower slot 35B separated by a transverse member 350 that extends across opposing sides of the slot. The transverse member 350 provides additional structural strength to the housing 15.

Figure 7:
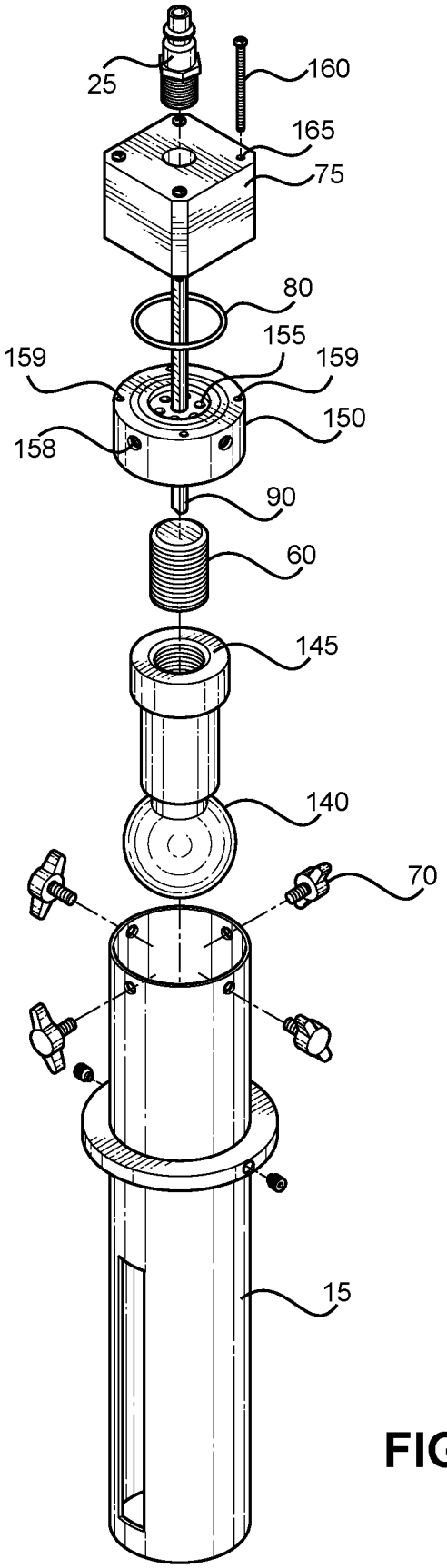
FIG. 7 shows an exploded view of a second alternate embodiment of the hole boring device.
Figure 8:
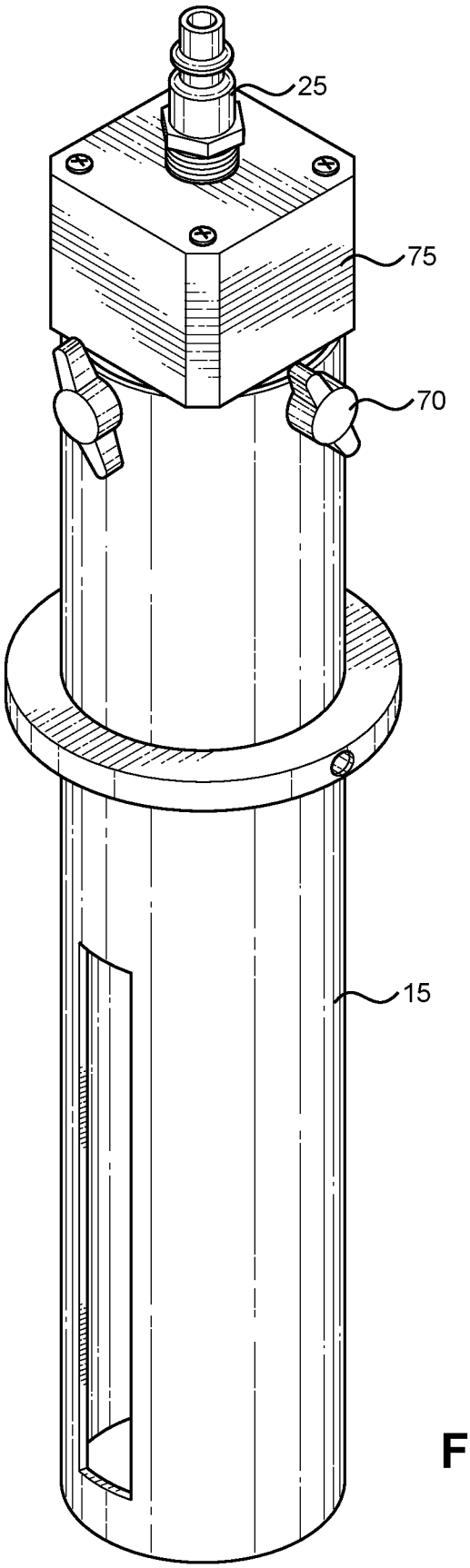
FIG. 8 shows a perspective view of a second alternate embodiment of the hole boring device.
Figure 9:
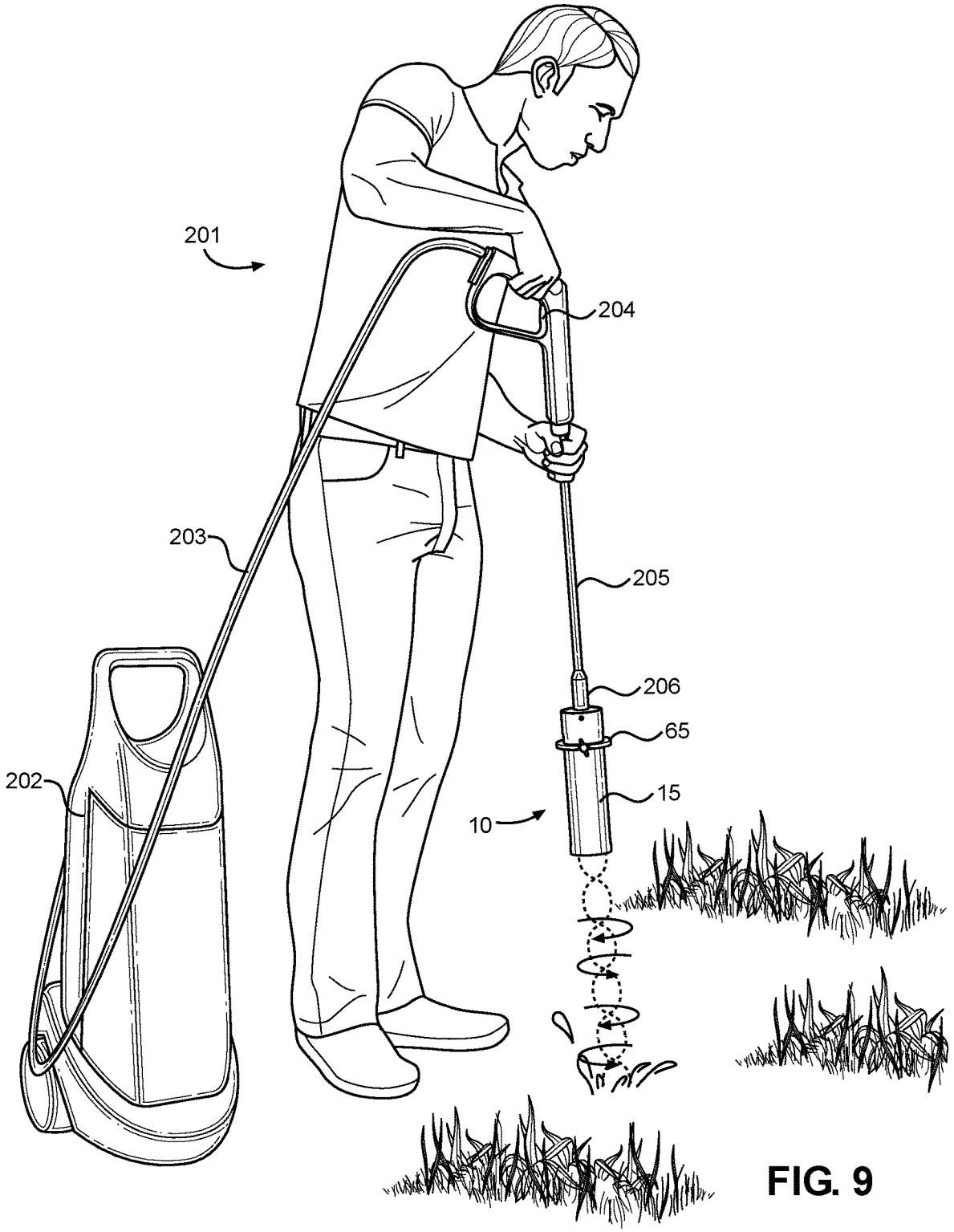
FIG. 9 shows a perspective view of one embodiment of the hole boring device in use.

Referring now to FIGS. 6 and 7, there is shown an exploded view of a second alternate embodiment of the hole boring device and a perspective view of a second alternate embodiment of the hole boring device, respectively. In the shown embodiment, the hole boring device 10 utilizes a motor to rotatably discharge water during the hole boring process. The shown embodiment, the hole boring device includes a motor including a motor housing 75 having a central opening through which the inlet 25 extends, and a shaft 90 extending downward from the motor housing 75. The motor housing 75 includes a plurality of fastening apertures 165 extending downward therethrough, and the upper end of the cover 150 includes a plurality of corresponding fastener apertures 159, such that a fastener 160 inserted through each fastener aperture 159 secures the motor housing 75 to the cover 150.

The cover 150 includes a central aperture through which the shaft 90 extends. The cover 150 further includes a plurality of water apertures 155 disposed annularly about the central aperture, which are in fluid communication with the inlet 25. In the shown embodiment, the cover 150 includes one or more fasteners 70 configured and one or more apertures 158 disposed annularly around the cover 150. The fasteners 70 are insertable through corresponding apertures on the housing 15 so as to removably secure to one or more apertures 158 disposed annularly around the cover 150, securing the cover 150 within the housing 15. In the shown embodiment, the cover further includes a channel having an O-ring 80 therein. The O-ring 80 creates a watertight seal between the motor housing 75 and the cover 150.

In the shown embodiment, the spraying device is a rotary spray ball 140, which includes an inlet 145 configured to receive a connection to a pressurized water source, wherein the inlet 145 is in fluid communication with the water apertures 155 of the cover 150. As shown, a nipple 60 connects the cover 150 to the rotary spray ball and allows water to flow thereto. The rotary spray ball 140 is operably connected to the shaft 90, such that actuation of the motor causes the shaft 90 and the coupled rotary spray ball 140 to rotate, forming a rotating discharge stream of water that exits through a plurality of outlets on the rotary spray ball 140 and out of the open distal end of the housing 15. The shown embodiment also includes the slot extending along the longitudinal length of the housing 15 which allows debris entering the bore to exit therethrough during the boring process. In some embodiments, the motor can be powered by an internal power source, such as a battery.

Referring now to FIG. 7, there is shown a view of the hydraulic hole boring device in use. The shown embodiment of the hydraulic hole boring device is contemplated for individual use, in that a user may connected the hydraulic hole boring device to a common pressurized water source, such as a power washer 202, via a connecting hose 203. However, other embodiments of the present invention designed for commercial applications can include a connection to a larger pressurized water source, such as a large tank mounted to the back of a truck or tractor. The length of connecting hose 203 can vary, and a spool or reel can be utilized if there exists a large distance between the hole boring site and the pressurized water source.

In operation, a user 201 may position the depth collar 65 at a point along the housing 15 corresponding to a desired boring depth, and then connect the hole boring device 10 to a pressurized water source, which is shown as a power washer 202 in the illustrated embodiment. The power washer 202 includes a connecting hose 203 that connects to a handle 204, which includes controls for selectively activating or deactivating the pressurized water spray. An extension 205 extends from the handle and includes a coupler 206 configured to connect to the inlet of the hole boring device 10.

After connecting to the power washer 202, the user then places the open distal end of the housing 15 perpendicularly above or against a ground surface and activates the power washer. Once the power washer is activated, the spraying device rotatably discharges pressurized water vertically downward through the ground surface, thereby forming a revolving, boring stream that bores a hole in the ground surface. The user applies a downward force to the hole boring device 10 via the handle 204 of the power washer 204, causing the housing 15 to enter the ground until the depth collar 65 makes contact with the perimeter edge of the bored hole, or the surface immediately adjacent the perimeter edge of the bored hole. In this way, the hole boring device 10 can be utilized to quickly and easily bore a hole of a desired depth via a rotating, pressurized water stream. Additionally, since water is being used to bore the hole, the present invention provides initial watering of the plant or bulb, thereby simultaneously completing the two tasks of hole drilling and initial watering. In some embodiments, a liquid fertilizer tank may be operably coupled to the pressurized water source, such that liquid fertilizer is mixed into the pressurized water stream that bores the hole. In this way, an individual can bore a hole, provide initial watering for the plant or bulb, and fertilize the plant or bulb with a single device.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hole boring device, comprising:

a linear housing including a proximal end, an open distal end, and a bore extending longitudinally from the distal end to the proximal end;

an inlet disposed on the proximal end, the inlet configured to receive a connection to a pressurized water source;

a spraying device disposed in the bore and oriented towards the open distal end, the spraying device in fluid communication with the inlet;

wherein the spraying device is configured discharge a stream of water passing therethrough so as to form a boring stream configured to bore a hole in a soil surface;

a collar disposed annularly about the housing, wherein the collar is slidable along a longitudinal length of the housing, the collar comprising a ring having a planar upper surface and a planar lower surface, the collar configured to define boring depth;

a plurality of collar apertures disposed on an outer side of the collar, each of the plurality of collar apertures configured to receive a collar set screw, wherein each collar set screw is configured to secure the collar in a desired position along the housing; and a slot extending along the longitudinal length of the housing and disposed between the proximal end and the open distal end, the slot in communication with the longitudinal bore such that debris entering the longitudinal bore during the hole boring process translates from the longitudinal bore through the slot and out of the housing, wherein the slot includes an upper slot opening, a lower slot opening, and a transverse member disposed therebetween, such that opposing ends of the transverse member are connected to opposing sides of the slot, wherein both the upper and lower slot openings extend from the longitudinal bore and the exterior out of the housing.

2. The hole boring device of claim 1, wherein the spraying device comprises a rotating nozzle configured to automatically rotate as a fluid passes therethrough, so as to rotate the boring fluid upon discharge from the nozzle.

3. The hole boring device of claim 1, further comprising:

a cover disposed within the bore at the proximal end of the housing, wherein the inlet extends through a central opening of the cover, the cover configured to seal the bore at the proximal end of the housing.

4. The hole boring device of claim 3, further comprising:

a plurality of cover apertures disposed on the proximal end of the housing;

a plurality of sidewall apertures disposed on a sidewall of the cover, the plurality of sidewall apertures corresponding to and aligning with the plurality of cover apertures;

a plurality of cover fasteners, each cover fastener insertable through one of the cover apertures and one of the sidewall apertures so as to secure the cover in place within the bore.

5. The hole boring device of claim 3, wherein the cover includes a planar perimeter portion disposed annularly about a central face that is offset from the planar perimeter portion.

6. The hole boring device of claim 3, wherein the central opening of the cover comprises a female threaded bore and the inlet comprises a male quick disconnect inlet configured to threadably engage the female threaded bore for removably securing the inlet to the proximal end of the elongated housing.

7. The hole boring device of claim 1 wherein the slot includes a length less than a longitudinal length of the housing, such that the slot is coterminous with neither the proximal end nor the open distal end.

8. The hole boring device of claim 1, wherein the spraying device includes a nipple in fluid communication with the inlet.

* * * * *